United States Patent [19]

Cox

[11] 4,004,543

[45] Jan. 25, 1977

[54] MANUALLY OPERATED PROPELLING APPARATUS FOR A BOAT

[76] Inventor: Zesely B. T. Cox, Redmond Road, Rome, Ga. 30161

[22] Filed: Mar. 4, 1975

[21] Appl. No.: 555,120

[52] U.S. Cl. ..... 115/24

[51] Int. Cl.[2] ..... B63H 16/14

[58] Field of Search ..... 115/24, 24.3; 74/413; 416/76

[56] References Cited

UNITED STATES PATENTS

| | | | |
|---|---|---|---|
| 454,165 | 6/1891 | Dennison | 416/76 |
| 2,273,815 | 2/1942 | Bevington | 115/24 |
| 2,684,045 | 7/1954 | Cato | 115/24 |
| 2,739,562 | 3/1956 | Hahs | 115/24 |

*Primary Examiner*—Trygve M. Blix
*Assistant Examiner*—Gregory W. O'Connor
*Attorney, Agent, or Firm*—Herbert M. Hanegan

[57] ABSTRACT

A manually operated propelling apparatus for a boat comprising a clamp for attaching the propelling apparatus to the transom of the boat, a propeller shaft housing attached to the clamp, a driving gear device attached to one end of the propeller shaft housing and a flexible propeller shaft within the propeller shaft housing attached to the driving gear means at one end and to a propeller at the other end.

15 Claims, 2 Drawing Figures

MANUALLY OPERATED PROPELLING APPARATUS FOR A BOAT

FIELD OF THE INVENTION

The present invention relates to small boats and more particularly to an apparatus detachably secured to a boat transom whereby manual operation of a driving gear means drives a propeller for moving and steering the boat.

It is desirable when fishing from a small boat, or the like, to have some inexpensive means of slowly propelling the boat through the water while casting or trolling.

This invention provides an apparatus which includes a propeller connected by a housing to a boat transom and manually driven by the operator circularly moving the driving gear means with one hand, thus leaving his other hand free.

DESCRIPTION OF THE PRIOR ART

Small boat trolling motors presently used include an electric motor necessitating the use of a battery as a source of energy. This type of outboard trolling motor is satisfactory from an operational standpoint but requires a certain amount of maintenance including recharging of the battery. Other types of outboard drives for small boats which are manually operated have been proposed, such as shown by U.S. Pat. No. 2,956,535, which features a manually operated crank connected by a chain and spocket means with a propeller for driving the latter. A somewhat similar manually operated device is shown by U.S. Pat. No. 3,010,421, which features a seat mounted above a boat transom with upstanding and depending members respectively supporting manually operated cranks and a propeller with the cranks connected to the propeller by a flexible drive.

This invention is distinctive over the electric driven trolling motor and the devices disclosed by these patents by providing a housing removably connected with a transom and containing a flexible drive shaft for driving a propeller connected at its depending end through driven gear means, while drive gear means connected at the upper end portion of the shaft rotates the shaft by a manually operated sun gear arrangement.

DESCRIPTION OF THE PREFERRED EMBODIMENT

Figure 1:
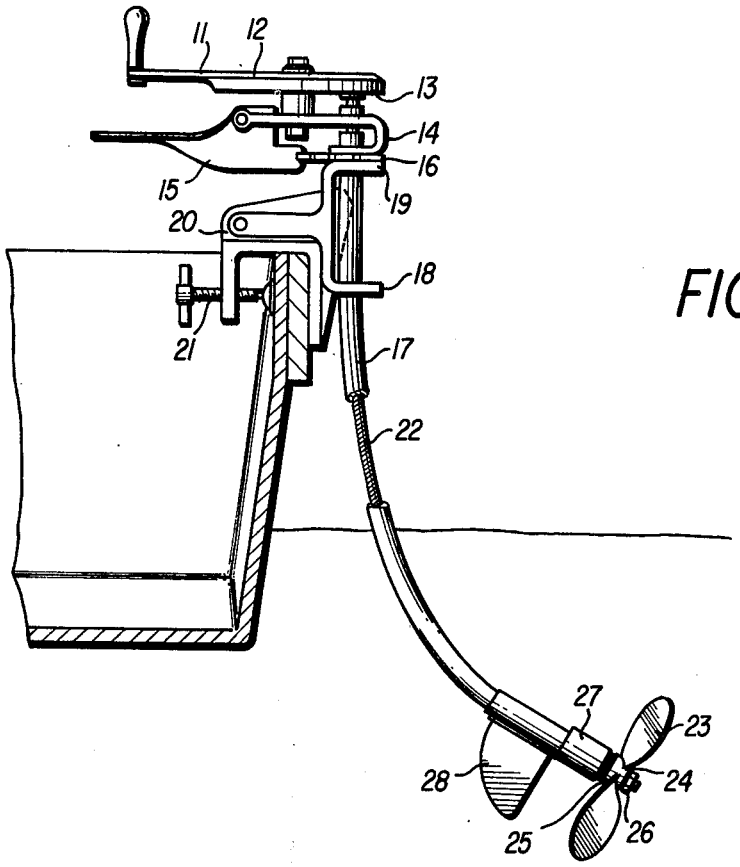
FIG. 1 is a side elevation view of the apparatus, partially in section, in operative position on a small boat, a fragment of the latter being shown by dotted lines.
Figure 2:
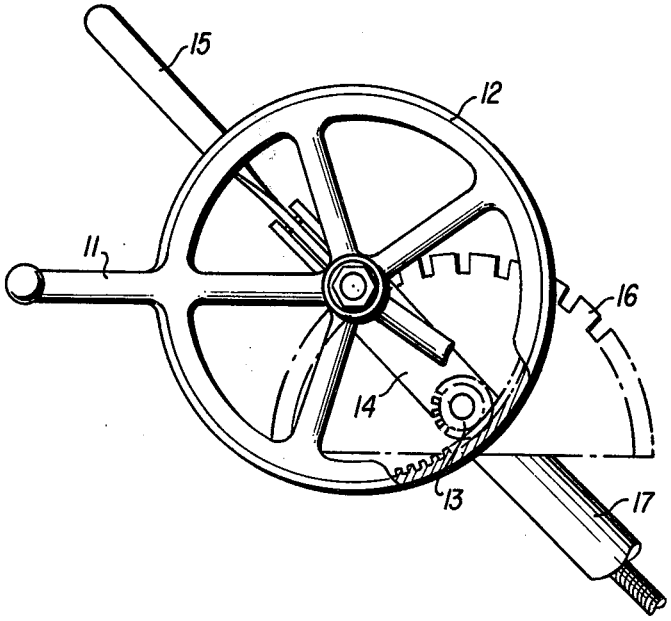
FIG. 2 is a fragmentary top view of the apparatus with the propeller removed.

Like characters of reference designate like parts in those figures of the drawings in which they occur. Crank handle 11 is fixedly connected to large gear 12 of the driving means. As clearly shown in FIG. 2 large gear 12 includes a flange which covers the internal gears of large gear 12 and a substantial portion of the gears of small gear 13. Small gear 13 is the driven gear of said driving means and is driven in a sun gear relationship when circular motion is imparted to handle 11. Large gear 12 is attached to base 14 such that gear 12 will rotate about its vertical axis, and as shown in FIG. 2, includes a flange which covers the internal gear teeth of 12 and a portion of the external teeth of driven gear

13. Driven gear 13 is attached to one end of flexible propeller shaft 22. Propeller 23 is attached to the other end of flexible propeller shaft 22. Base 14 is fixedly attached to propeller shaft housing 17, which is moveably attached to transom clamp 20 through circular opening end elements 18 and 19 of clamp 20. Notched circular band 16 is fixedly attached to clamp 20 and moveably attached to propeller shaft housing 17. The transom clamp allows the complete unit to rotate 360°, and can be mounted on any part of a boat. Preferably, notched circular band 16 is in the form of a semicircle and allows for 180° rotation of the unit. Clamp screw 21 forms a clamp screw socket with the opposite wall of clamp 20 and provides for attaching the propulsion unit to a boat transom.

Transom clamp 20 pivotally connects the unit to the boat transom and is substantially C-clamp-shaped in general configuration and permits vertical tilting movement of the unit about the horizontal axis. Locking lever 15 is mounted for vertical movement on base 14 and is in communicating relationship with circular band 16. Movement of locking lever 15 in the horizontal plane results in rotational movement of the entire unit other than clamp 20 and circular band 16.

Flexible propeller shaft 22 is contained within shaft housing 17. Preferably, shaft housing 17 is at least partially filled with a lubricant to insure more efficient operation of the propelling apparatus. Rudder 28 is attached to propeller shaft housing 17 in close proximity to propeller 23. Propeller 23 is attached to flexible propeller shaft 22 by means well known in the art. Such means may be by use of a threaded end of flexible shaft 22 and a bolt, 26, to secure propeller 23 to the unit.

Propeller shaft housing 17 may be threaded on the end adjacent the propeller and a coupling, 27, attached thereto. Bushings 25 and 24 on either side of propeller 23 prevent the shifting of propeller 23 in relation to shaft housing 17. Bushing 25 also retains the lubricant within propeller shaft housing 17. Bushings 25 and 24 may be bearings to increase the efficiency of the propulsion unit.

The flexible propeller shaft may be manufactured of any appropriate material. Advantageously, the flexible shaft is manufactured of one or more of the following materials: steel, steel alloys, copper, copper alloys, aluminum, aluminum alloys, synthetic and natural plastics, and synthetic and natural fibers. Preferably the flexible propeller shaft is manufactured of steel or steel alloys. The flexible propeller shaft may be either a solid wire or rod or a stranded configuration such as a stranded cable. Preferably the configuration of the flexible propeller shaft is a stranded cable of approximately ½ inch diameter.

The ratio of the diameter of the driving gear to the diameter of the driven gear of the sun gear arrangement driving gear means may be any desired ratio. Advantageously, the ratio of the diameter of the driving gear to the diameter of the driven gear is at least 2:1. Preferably the diameter of the driving gear is approximately 6 ½ inches and the diameter of the driven gear is approximately 1 ½ inches.

The entire propelling apparatus may be made of any appropriate material such as steel, iron, steel alloys, aluminum, aluminum alloys, copper, copper alloys, synthetic and natural plastics, and synthetic and natural fibers. It is desirable that the weight of the unit be kept to a minimum, therefore as many parts as possible should be made of lightweight material such as aluminum, aluminum alloys, synthetic and natural plastics, and synthetic and natural fibers. Some of the elements of the unit are subjected to more stress than others, such as the driving gear, driven gear and flexible shaft. Advantageously, these elements are made of material having greater strength such as steel, steel alloys, copper and copper alloys.

It will be evident from the foregoing that the propelling mechanism is a portable unit which can be easily fitted to any small boat or other water craft, or removed therefrom. While the device has been shown and described as manually operated, it would be obvious that a suitable power means may be used with the same without departing from the scope and spirit of this invention.

What is claimed is:

1. A manually operated propelling apparatus for a boat comprising:

a. a clamp for attaching the propelling apparatus to the transom of a boat;

b. a propeller shaft housing attached to said clamp;

c. a sun gear driving arrangement, wherein the interior member is the driven gear and the exterior member is the drive gear having internal gear teeth and having a flange which covers the internal gear teeth of said drive gear and which covers a substantial portion of the gear teeth of said driven gear, attached to one end of said propeller shaft housing; and d. a flexible propeller shaft within said propeller shaft housing attached to said sun gear arrangement at one end and to a propeller at the other end.

2. The propelling apparatus of claim 1 wherein said sun gear arrangement the driven gear is attached to the flexible propeller shaft and the driving gear is attached to the propeller shaft housing.

3. The propelling apparatus of claim 1 including a rudder means attached to the propeller shaft housing in close proximity to the propeller.

4. The propelling apparatus of claim 1 wherein said flexible shaft is manufactured of steel.

5. The propelling apparatus of claim 1 having a lubricant within the propeller shaft housing.

6. The propelling apparatus of claim 1 wherein the ratio of the diameter of the driving gear of the sun gear arrangement to the diameter of the driven gear of the sun gear arrangement is at least 2:1.

7. The propelling apparatus of claim 1 wherein the flexible shaft is a stranded cable.

8. The propelling apparatus of claim 1 including a steering mechanism having a locking lever attached to the sun gear arrangement so as to allow vertical movement of said lever in a vertical plane, without moving the steering mechanism, however any horizontal movement of said lever resulting in movement of the steering mechanism in the horizontal plane, a circular band rigidly attached to said propeller shaft housing in communicating relationship with said lever and disposed in the horizontal plane, having its edge notched for locking engagement with the lever, the lever through its attachment to the sun gear arrangement and the circular band through its attachment to the propeller shaft housing serving to rotate the housing and associated elements to various degrees of horizontal angularity.

9. The propelling apparatus of claim 8 wherein the notched band is a semicircle allowing 180° rotation of the propeller shaft housing.

10. The propelling apparatus of claim 1 wherein the transom clamp is pivotally attached to the propeller shaft housing allowing pivotal movement of the propeller shaft housing about a horizontal axis.

11. The propelling apparatus of claim 1 wherein said flexible shaft is manufactured of steel alloys.

12. The propelling apparatus of claim 1 wherein said flexible shaft is manufactured of copper.

13. The propelling apparatus of claim 1 wherein said flexible shaft is manufactured of copper alloys.

14. The propelling apparatus of claim 1 wherein said flexible shaft is manufactured of aluminum.

15. The propelling apparatus of claim 1 wherein said flexible shaft is manufactured of aluminum alloys.

* * * * *